US009506693B2

(12) United States Patent
Pauling

(10) Patent No.: US 9,506,693 B2
(45) Date of Patent: Nov. 29, 2016

(54) GRAIN DRYERS WITH SELECTABLE DUCTS FOR COOLING

(71) Applicant: Kelly Brian Pauling, Maynard, MN (US)

(72) Inventor: Kelly Brian Pauling, Maynard, MN (US)

( * ) Notice: Subject to any disclaimer, the term of this patent is extended or adjusted under 35 U.S.C. 154(b) by 132 days.

(21) Appl. No.: 14/466,125

(22) Filed: Aug. 22, 2014

(65) Prior Publication Data

US 2016/0054058 A1 Feb. 25, 2016

(51) Int. Cl.

*F26B 9/06* (2006.01)
*F26B 17/12* (2006.01)
*F26B 17/14* (2006.01)

(52) U.S. Cl.

CPC ..... *F26B 17/122* (2013.01); *F26B 17/14* (2013.01); *F26B 17/1408* (2013.01); *F26B 17/1416* (2013.01); *F26B 2200/06* (2013.01)

(58) Field of Classification Search

CPC ..... F26B 3/00; F26B 5/00; F26B 9/00; F26B 9/06; F26B 17/12; A01D 41/12; B01F 7/00; B01F 7/24

USPC ..... 34/165, 167, 169, 201, 218, 235, 186; 56/153, 157; 366/261; 432/14, 98

See application file for complete search history.

(56) References Cited

U.S. PATENT DOCUMENTS 3,896,562 A 7/1975 Zimmerman
3,913,239 A * 10/1975 Burgin ..... F26B 3/00 34/102
3,955,288 A * 5/1976 Keirn ..... F26B 17/122 34/171
4,009,520 A * 3/1977 Sukup ..... F26B 9/103 34/233
4,149,844 A 4/1979 Noyes
4,209,918 A * 7/1980 Klein ..... F28C 3/005 34/182
4,242,806 A 1/1981 McClaren
4,249,891 A 2/1981 Noyes et al.
4,255,130 A * 3/1981 Johnson, Jr. ..... F27B 7/2016 34/171
4,308,669 A 1/1982 Noyes et al.
4,337,584 A 7/1982 Johnson
4,423,557 A 1/1984 Westelaken
4,914,834 A 4/1990 Sime
5,113,643 A * 5/1992 Peterson ..... A01D 41/1252 56/153
5,156,570 A * 10/1992 Justice, III ..... A01D 41/133 34/180
6,122,838 A * 9/2000 Bloemendaal ..... F26B 17/124 34/167
6,158,143 A 12/2000 Da Cunha
6,202,319 B1 3/2001 Bening
7,007,402 B1 3/2006 Gillette
7,568,297 B2 * 8/2009 Pierson ..... F26B 9/103 219/697

(Continued)

FOREIGN PATENT DOCUMENTS

CN 103229829 B 2/2014
DE 3400397 A1 * 11/1984 ..... A23B 7/03

(Continued)

OTHER PUBLICATIONS

"Mixed Flow Dryer", Energy Self Assessment from the United States Department of Agriculture Natural Resources Conservation Service, http://www.ruralenergy.wisc.edu, retrieved on Aug. 5, 2014, 2 pgs.

*Primary Examiner* — Stephen M Gravini
(74) *Attorney, Agent, or Firm* — Dicke, Billig & Czaja, PLLC

(57) ABSTRACT

A grain dryer has a grain column configured to receive grain to be dried and ducts extending from a first wall of the grain column to a second wall of the grain column. The grain dryer is configured so that different numbers of the ducts are selectable for handling cooling air used for cooling the grain.

20 Claims, 5 Drawing Sheets

(56) References Cited

U.S. PATENT DOCUMENTS

| | | | | |
|---|---|---|---|---|
| 7,818,894 | B2 | 10/2010 | Noyes et al. | |
| 8,356,420 | B2 * | 1/2013 | Morrison | F26B 17/124 209/134 |
| 8,677,648 | B2 * | 3/2014 | Schreiner | B65D 88/742 34/218 |
| 2015/0241123 | A1 * | 8/2015 | Morrison | F26B 17/12 34/86 |
| 2016/0054058 | A1 * | 2/2016 | Pauling | F26B 9/063 34/235 |

FOREIGN PATENT DOCUMENTS

| | | | | |
|---|---|---|---|---|
| GB | 988251 | A * | 4/1965 | F26B 17/122 |
| JP | 63282406 | A * | 11/1988 | |
| KR | 100881867 | B1 * | 2/2009 | |

* cited by examiner

GRAIN DRYERS WITH SELECTABLE DUCTS FOR COOLING

FIELD

The present disclosure relates generally to grain dryers, and, in particular, the present disclosure relates to grain dryers configured so that different numbers of ducts in a grain column are selectable for cooling.

BACKGROUND

Duct-type grain dryers (e.g., sometimes called mixed-flow grain dryers) typically do not have any screens that can plug or that may need to be cleaned. This can reduce the need for maintenance and may allow a wide variety of different grains to be dried.

In duct-type grain dryers, grain may flow downward under the influence of gravity, e.g., through a grain column containing a plurality of ducts. The grain may be dried by passing heated air through the grain as the grain flows downward through the grain column. In some duct-type grain dryers, some of the ducts in the grain column might direct the heated air into contact with the downward flowing grain. The heated air may then flow through the downward flowing grain and may be subsequently cooled by the grain. The cooled air may then be directed from the grain column by other ducts in the grain column.

In some applications, after heated drying, the grain might be cooled before the grain exits the grain dryer, e.g., to prevent deterioration during storage. Some duct-type grain dryers, for example, might use pressurized air cooling in their grain columns. For example, ducts might be used to direct the pressurized cooling air into the grain. However, pressurized cooling can result in undesirable heat loss and energy consumption.

For the reasons stated above, and for other reasons stated below which will become apparent to those skilled in the art upon reading and understanding the present specification, there is a need in the art for alternatives to existing cooling systems for duct-type grain dryers.

DETAILED DESCRIPTION

Figure 1:
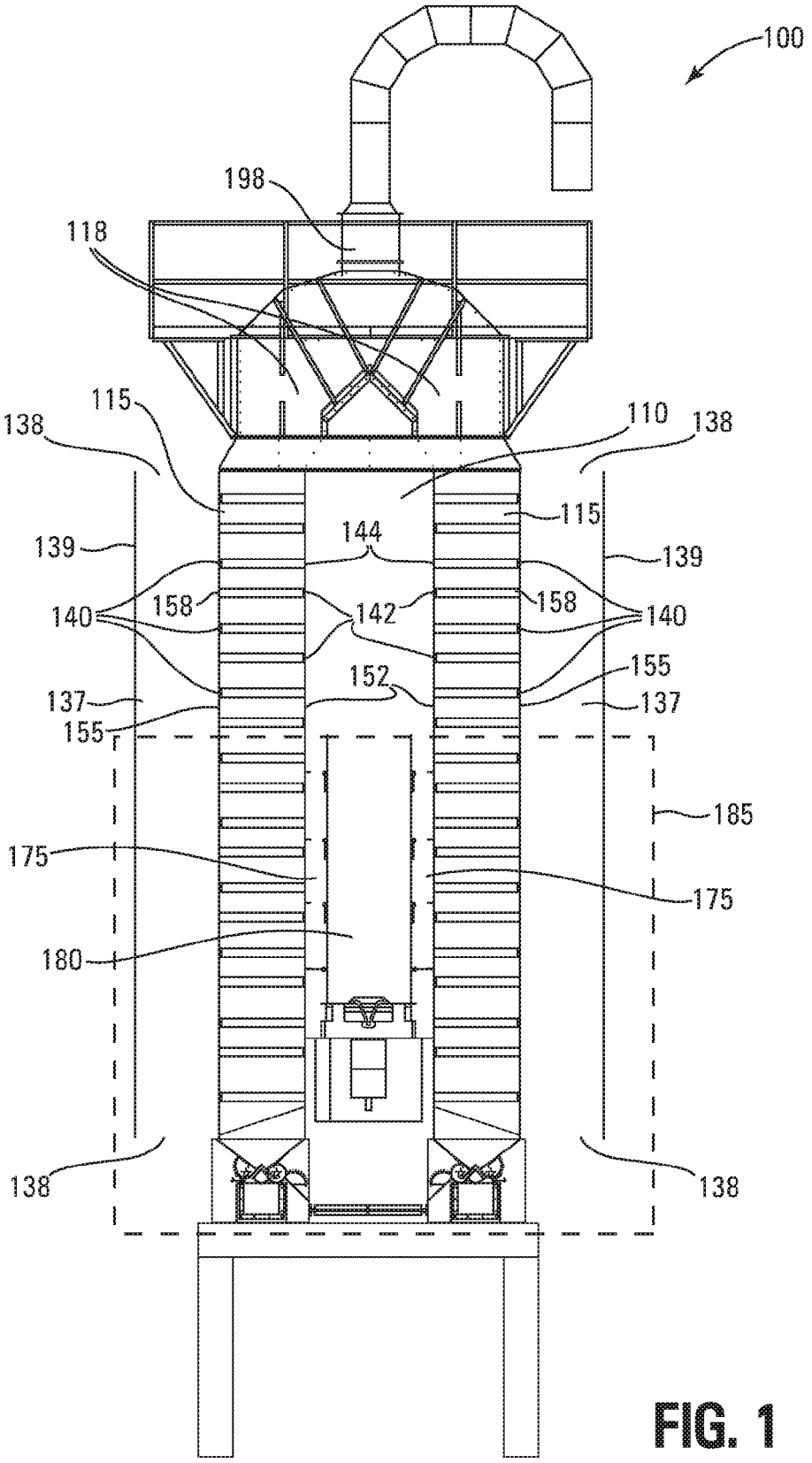
FIG. 1 is a cutaway end view of an example of an interior of a grain dryer.

In the following detailed description, reference is made to the accompanying drawings that form a part hereof, and in which is shown, by way of illustration, specific embodiments. In the drawings, like numerals describe substantially similar components throughout the several views. Other embodiments may be utilized and structural and mechanical changes may be made without departing from the scope of the present disclosure. The following detailed description is, therefore, not to be taken in a limiting sense.

Figure 2:
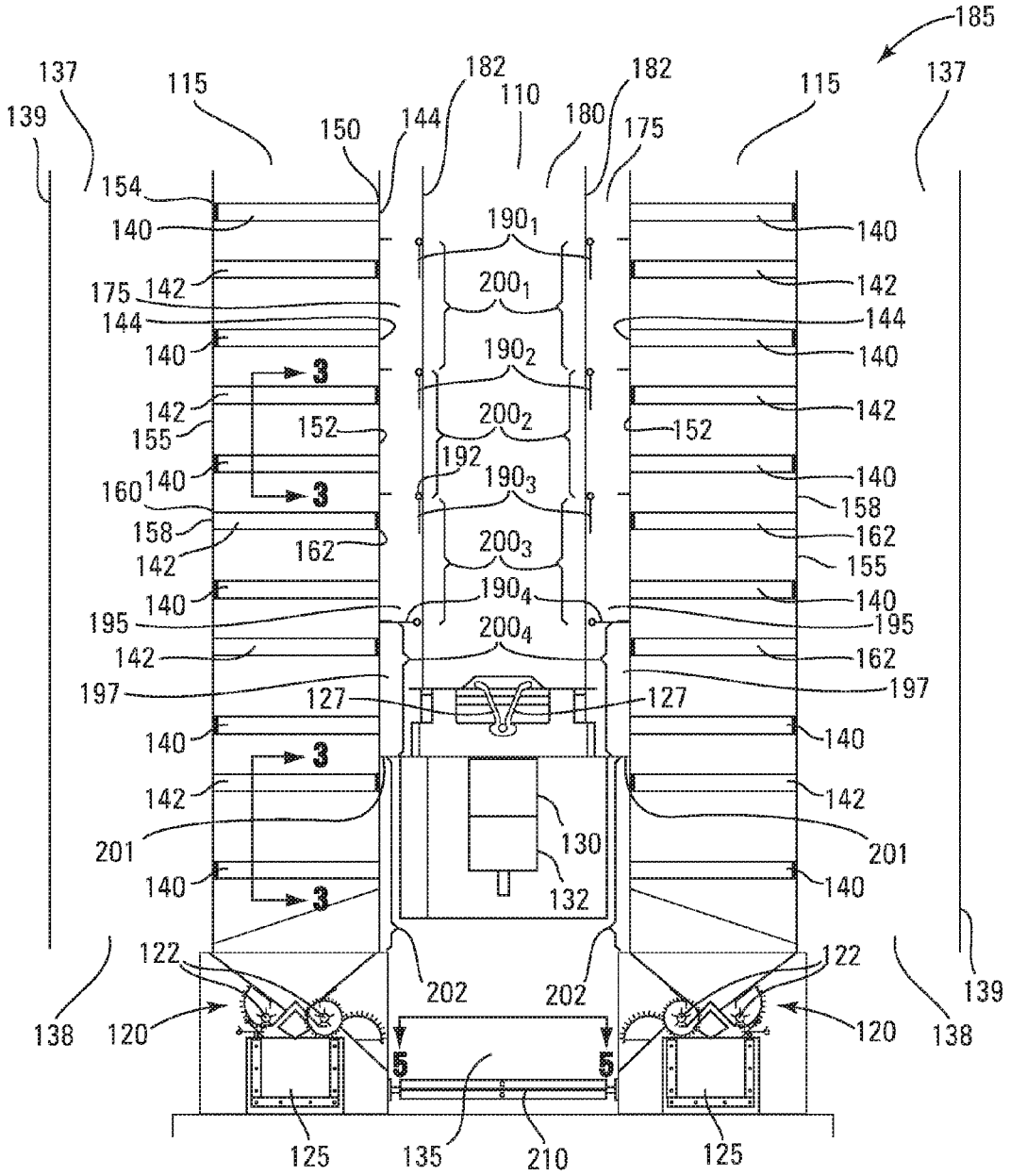
FIG. 2 is an enlarged view of region 185 in FIG. 1.

FIG. 1 is a cutaway end view of an interior of a duct-type grain dryer 100. FIG. 2 is an enlarged view of region 185 in FIG. 1. For some embodiments, grain dryer 100 might not have any screens, e.g., grain dryer 100 might be screenless.

Grain dryer 100 may include a duct (e.g., a plenum) 110, that may be vertical, between ducts (e.g., grain columns) 115 that might be identical to each other and that might be vertical. Grain (e.g., "wet" grain) to be dried may be received in grain columns 115 from a garner bin 118. The grain might be gravity fed downward through grain columns 115 into metering sections 120 that may respectively include motor-driven metering rolls 122, as shown in FIG. 2. The rotational speed of metering rolls might control the rate at which the grain flows through each of grain columns 115. For example, the higher the rotational speed of the metering rolls; the higher the rate at which the grain flows through grain columns 115. Metering sections 120 respectively direct the grain onto conveyers 125.

It should be recognized the term vertical takes into account variations from "exactly" vertical due to routine manufacturing and/or assembly variations and that one of ordinary skill in the art would know what is meant by the term vertical.

A burner 127 may be located in the interior of grain dryer 100, below duct 110 and between the respective grain columns 115. A motor-driven blower (e.g., fan) 130, such as an axial blower, may be located in the interior of grain dryer 100, below burner 127 and between the respective grain columns 115. Operation of blower 130 may cause an inlet 132 (e.g., the suction side) of blower 130 and a region 135 (e.g., that might be referred to as a tub) of grain dryer 100 that is below blower 130 and fluidly coupled to inlet 132 to be at vacuum pressure, e.g., below the atmospheric pressure of the outside air external to grain dryer 100. Blower 130 directs air through burner 127 that is fluidly coupled to an outlet (e.g., the pressure side) of blower 130. Burner 127 subsequently heats the air for drying the grain in grain columns 115.

As used herein "fluidly coupled" means to allow the flow of fluid (e.g., air). For example, air is allowed to flow between fluidly coupled elements, i.e., from one of the fluidly coupled elements to the other. For selectively fluidly coupled elements, air flows from one of the elements to the other in response to an action, such as the opening of a damper between the elements. That is, when one or more dampers are between two elements, the two elements are selectively fluidly coupled to each other, for example. When ducts are fluidly coupled to a region or element, the flow passages within these ducts are fluidly coupled to the region or element, for example.

Each of grain columns 115 might be between duct 110 and a respective duct (e.g., air cavity) 137 that opens to and that is fluidly coupled, through openings 138, to the outside air (e.g., atmospheric air) that is external to and that surrounds grain dryer 100. For example, air cavities 137 might be at the pressure of the outside air.

Each air cavity 137 might between a respective heat shield 139 and a respective one of grain columns 115. That is, the respective heat shield 139 might form at least a portion of an exterior shell of grain dryer 100, for example. For example, an exterior surface of heat shield 139 might be in contact with the outside air that is external to and that surrounds grain dryer 100. That is, for example, each heat shield 139 may be between the outside air and a respective air cavity 137. Heat shields 139 might be made from galvanized steel, for example.

Each of the grain columns 115 includes a plurality of ducts (e.g., channels) 140 and a plurality of ducts (e.g., channels) 142. For example, each of ducts 140 and 142 may be between duct 110 and an air cavity 137. Ducts 140 and 142 might alternate along the lengths of grain columns 115 so that a respective duct 142 is at a vertical elevation between the vertical elevations of successively adjacent ducts 140. That is, for example, respective ones of ducts 142 might be between successively adjacent ducts 140.

Each of ducts 140 might open into duct 110. For example, each duct 140 might have an inlet/outlet 144 at one of its ends, such as an end 150 (FIG. 2), that opens into duct 110, e.g., though a wall 152 of a respective grain column 115 adjacent to duct 110, as shown in FIG. 2. An opposite end of that duct 144, such as an end 154, might be closed by a portion of a wall 155 of the respective grain column 115 adjacent to a respective air cavity 137, as shown in FIG. 2.

For example, ducts 140 might be horizontal and might span the entire distance between walls 152 and 155 of a grain column 115. Ducts 140 might be transverse (e.g., perpendicular to within routine manufacturing and/or assembly variations) to the direction of the grain flow in grain columns 115, for example.

It should be recognized that the term horizontal takes into account variations from "exactly" horizontal due to routine manufacturing and/or assembly variations and that one of ordinary skill in the art would know what is meant by the term horizontal. It should be recognized that vertical and horizontal are perpendicular to each other to within routine manufacturing and/or assembly variations.

Each of ducts 142 might open into a respective air cavity 137. For example, each duct 142 might have inlet/outlet 158 at one of its ends, such as an end 160 (FIG. 2), that opens into a respective air cavity 137, e.g., though a respective wall 155, as shown in FIG. 2. An opposite end of that duct 142, such as an end 162, might be closed by a portion of a respective wall 152, as shown in FIG. 2.

For example, ducts 142 might be horizontal and might span the entire distance between walls 152 and 155 of a grain column 115. Ducts 142 might be transverse (e.g., perpendicular) to the direction of the grain flow in grain columns 115, for example.

A lower portion of duct 110 might include an outer duct (e.g., channel) 175 on either side of an inner duct (e.g., channel) 180, as shown in FIGS. 1 and 2. For example, a wall 182 of a pair of walls 182 might be between a respective one of outer ducts 175 and inner duct 180. Burner 127 might be located within inner duct 180 between walls 182, as shown in FIGS. 1 and 2. Inner duct 180 is configured to receive pressurized air exiting the pressure side (e.g., the outlet) of blower 130. Outer ducts 175 and inner duct 180 might be vertical, for example.

Each of a plurality of dampers 190, such as dampers $\mathbf{190}_1$ to $\mathbf{190}_4$ (FIG. 2), might be configured to selectively partition each of outer ducts 175 into two regions, e.g., a region above a respective damper and a region below the respective damper. Each of dampers $\mathbf{190}_1$ to $\mathbf{190}_4$ might be configured to be selectively opened and closed. For example, each of dampers $\mathbf{190}_1$ to $\mathbf{190}_4$ might be configured to be selectively moved from an open position, e.g., as shown for each of dampers $\mathbf{190}_1$ to $\mathbf{190}_3$ in FIG. 2, to a closed position, e.g., as shown for damper $\mathbf{190}_4$ in FIG. 2. In its closed position, damper $\mathbf{190}_4$ extends across a respective duct 175 from a respective wall 182 to respective wall 152. Each of dampers $\mathbf{190}_1$ to $\mathbf{190}_4$ may be configured to be selectively pivoted, e.g., about a shaft 192, between its open and closed positions.

When a damper 190 is closed, that damper 190 partitions (e.g., divides) a respective duct 175, and thus an adjacent grain column 115, into a region above the closed damper 190 and a region below the closed damper 190. For example, each of closed dampers $\mathbf{190}_4$ partitions its respective duct 175 into a region 195 above that closed damper $\mathbf{190}_4$ and a region 197 below that closed damper $\mathbf{190}_4$, e.g., by closing region 195 off from region 197, as shown in FIG. 2. That is, for example, a region in a respective grain column 115 above a closed damper $\mathbf{190}_4$ might correspond to the region 195 in an adjacent duct 175, and a region in the respective grain column 115 below that closed damper $\mathbf{190}_4$ might correspond to the region 197 in the adjacent duct 175.

The region in a grain column 115 above a closed damper 190, such as closed damper $\mathbf{190}_4$, might be subjected to heating, where heating air might flow from the region in the adjacent duct 175 above the closed damper 190, such as region 195 above closed damper $\mathbf{190}_4$, into the region in that grain column 115 above the closed damper 190 through the inlet/outlets 144 of ducts 140 that open into the adjacent duct 175. The air may then flow from region in the grain column 115 above the closed damper 190 into the adjacent air cavity 137 through inlet/outlets 158.

The region in a grain column 115 below a closed damper 190, such as closed damper $\mathbf{190}_4$, might be subjected to cooling, where cooling air might flow from the adjacent air cavity 137 into the region in that grain column 115 below the closed damper 190 through the inlet/outlets 158 of ducts 142 that open into that air cavity 137. The air may then flow from region in the grain column 115 below the closed damper 190 into the region in the adjacent duct 175 below the closed damper 190, such as region 197 below closed damper $\mathbf{190}_4$, through inlet/outlets 144. For example, a closed damper 190 might select region in a grain column 115 above the closed damper 190 for heating and a region in that grain column 115 below the closed damper 190 for cooling.

A portion of a grain column 115 might have a plurality zones adjacent to a duct 175 that are defined by the locations of dampers 190. For example, zone $\mathbf{200}_1$, zone $\mathbf{200}_2$, and zone $\mathbf{200}_3$ of a grain column 115 might respectively be between successively adjacent dampers $\mathbf{190}_1$ and $\mathbf{190}_2$, successively adjacent dampers $\mathbf{190}_2$ and $\mathbf{190}_3$, and successively adjacent dampers $\mathbf{190}_3$ and $\mathbf{190}_4$. A zone $\mathbf{200}_4$ might be between damper $\mathbf{190}_4$ and a lowermost end (e.g., an outlet) 201 of a duct 175. A lowermost zone 202 of a grain column 115 might be below the outlet 201 of a duct 175.

When all of dampers $\mathbf{190}_1$ to $\mathbf{190}_4$ adjacent to a respective grain column 115 are open, all of the zones 200 of the respective grain column 115 might be subjected to heating, while the lowermost zone 202 is subjected to cooling. For example, lowermost zone 202 might always be subjected to cooling, regardless of the state (e.g., open or closed) of any of dampers $\mathbf{190}_1$ to $\mathbf{190}_4$.

Note that the number of the zones 200 of each grain column 115, and thus the length of each grain column 115 subjected to cooling, may be selectively adjustable using the dampers 190. For example, selectively closing dampers $\mathbf{190}_4$ and leaving the remaining dampers $\mathbf{190}_1$ to $\mathbf{190}_3$ selects zones $\mathbf{204}_4$ below closed dampers $\mathbf{190}_4$ for cooling and the remaining zones $\mathbf{200}_1$ to $\mathbf{200}_3$ above closed dampers $\mathbf{190}_4$ for heating. For example, selectively closing dampers $\mathbf{190}_3$ and leaving the remaining dampers $\mathbf{190}_1$, $\mathbf{190}_2$, and $\mathbf{190}_4$ open selects zones $\mathbf{200}_3$ to $\mathbf{200}_4$ below closed dampers $\mathbf{190}_3$ for cooling and the remaining zones $\mathbf{200}_1$ and $\mathbf{200}_2$ above closed dampers $\mathbf{190}_2$ for heating. For example, different ones of the plurality of dampers 190 are configured to respectively select different amounts (e.g., a different number of zones 200) of the grain columns for cooling.

Figure 3:
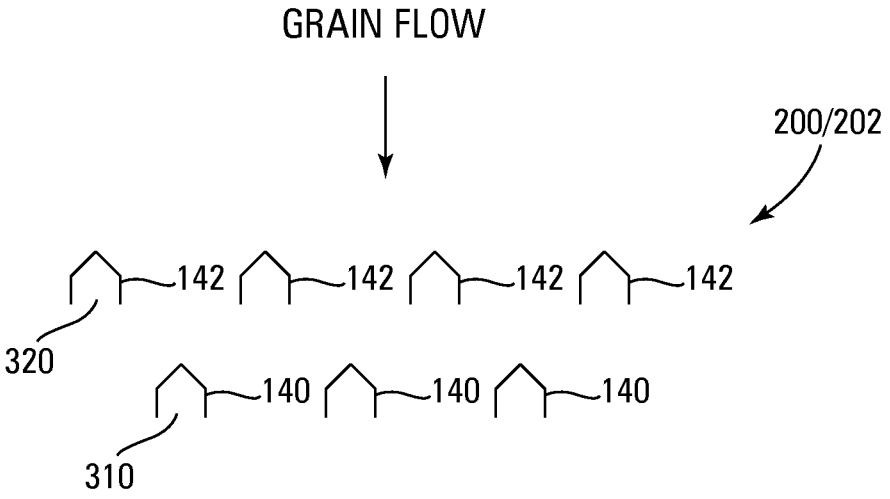
FIG. 3 is a view taken along the lines 3-3 in FIG. 2.

FIG. 3 is a view taken along the lines 3-3 in FIG. 2, showing the general layout of ducts 140 and 142 in a portion of a representative zone 200 and/or a representative zone 202. Note, for example, that each of ducts 140 might have an inlet/outlet (e.g. an opening) 310 along its bottom. For example, each duct 140 might be an open channel that faces downward toward the bottom of a respective grain column 115. An inlet/outlet 310, for example, might span the entire length of a respective duct 140, e.g., from wall 152 to wall 155 of a respective grain column 115.

Each of ducts 142, for example, might have an inlet/outlet (e.g. an opening) 320 along its bottom. For example, each duct 142 might be an open channel that faces downward toward the bottom of a respective grain column 115. An inlet/outlet 320, for example, might span the entire length of a respective duct 142, e.g., from wall 152 to wall 155 of a respective grain column 115.

Figure 4:
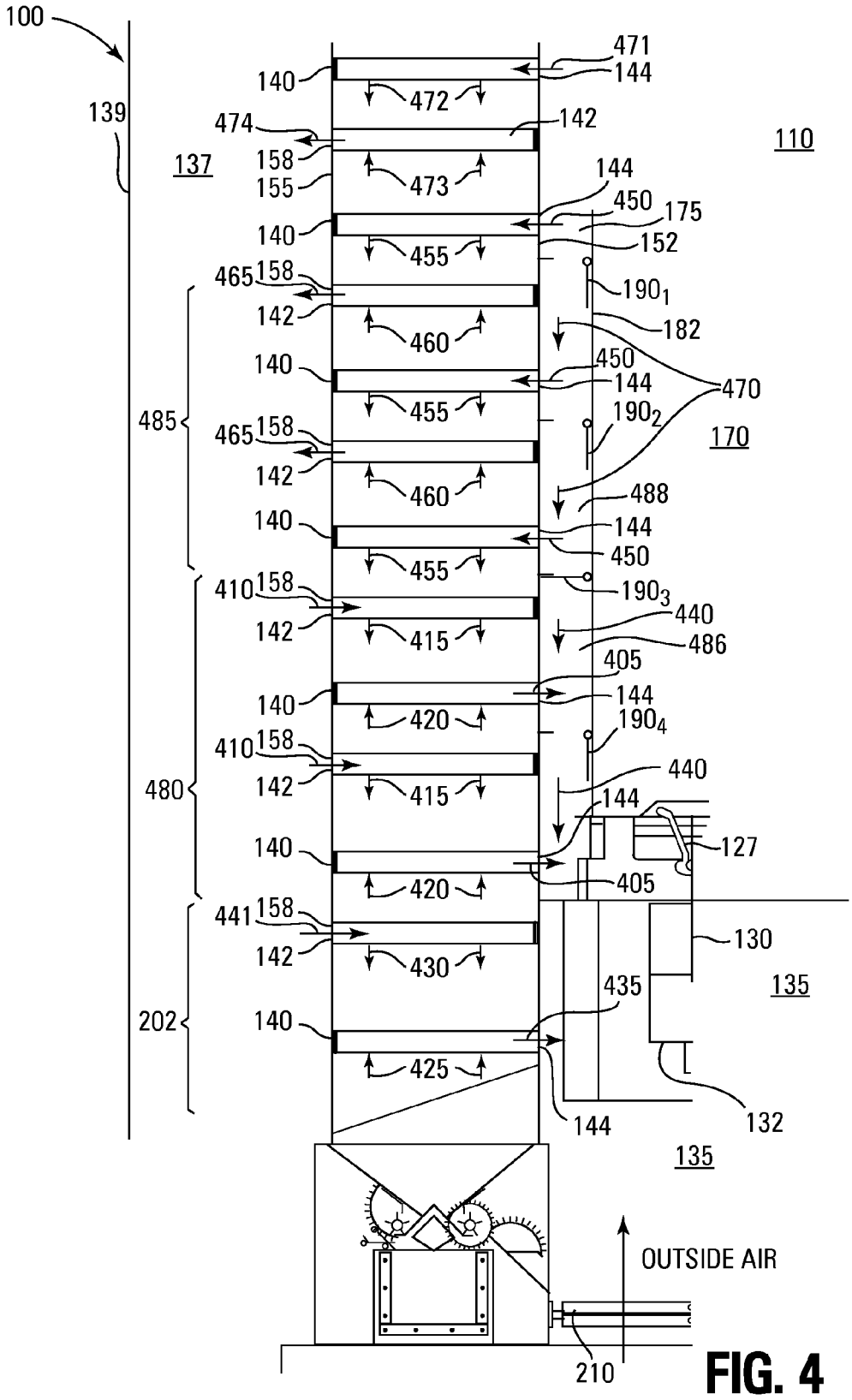
FIG. 4 illustrates cooling air flows and heating air flows in an enlarged view of a portion of the left side of FIG. 1.

FIG. 4 illustrates cooling air flows and heating air flows in an enlarged view of a portion of the left side of FIG. 1, including the left side of FIG. 2. Arrows 405, 410, 415, 420, 425, 430, 435, 440, and 441 represent flows of cooling air, and arrows 450, 455, 460, 465, 470, 471, 472, 473, and 474 represent flows of heating air.

In FIG. 4, a portion 480 of a respective grain column 115 is selected for cooling in that it is below closed damper $\mathbf{190}_3$. For example, closing damper $\mathbf{190}_3$ selects portion 480 for cooling. For example, portion 480 might include the zones $\mathbf{200}_3$ and $\mathbf{200}_4$ shown in FIG. 2. Note that zone $\mathbf{200}_4$ below closed damper $\mathbf{190}_4$ is selected for cooling in FIG. 2. Therefore, FIGS. 2 and 4 illustrate how closing different dampers (damper $\mathbf{190}_4$ in FIG. 2 and damper $\mathbf{190}_3$ in FIG. 4) respectively selects different portions (e.g., different lengths) of a grain column 115 for cooling, and thus different numbers of ducts 140 and different numbers of ducts 142 for handing cooling air for cooling the grain. For example, a larger number of ducts 140 and ducts 142 are used for handing cooling air in FIG. 4 when damper $\mathbf{190}_3$ is closed than in FIG. 2 when damper $\mathbf{190}_2$ is closed. Note that each of the grain columns 115 and the respective ducts 175 adjacent to grain columns 115 may be as described below in conjunction with FIGS. 3 and 4.

Portion 485 is subjected to heating in FIG. 4 in that it is above closed damper closed damper $\mathbf{190}_3$. For example, portion 485 might include the zones $\mathbf{200}_1$ and $\mathbf{200}_2$ shown in FIG. 2. Note that zones $\mathbf{200}_1$ to $\mathbf{200}_3$ above closed damper $\mathbf{190}_4$ are subjected to heating in FIG. 2. Therefore, FIGS. 2 and 4 illustrate how closing different dampers (damper $\mathbf{190}_4$ in FIG. 2 and damper $\mathbf{190}_3$ in FIG. 4) causes different portions (e.g., different lengths) of a grain column 115 to be subjected to heating. For example, the dampers $\mathbf{190}_1$ to $\mathbf{190}_4$ may be respectively configured to selectively close each of the respective the respective ducts 175 at different locations along a length of the respective ducts 175.

In portion 480 of the grain column 115 below closed damper $\mathbf{190}_3$ in FIG. 4, the closed damper $\mathbf{190}_3$ might cause cooling air to flow into a duct 142 from a respective air cavity 137, as shown by arrows 410, through the inlet/outlet 158 of that duct 142 that opens into the air cavity 137 and then to flow into grain column 115 from that duct 140, as shown by arrows 415, through the inlet/outlet 320 (FIG. 3) of that duct 142. The closed damper $\mathbf{190}_3$ might cause the cooling air to then flow into a duct 140 from grain column 115, as shown by arrows 420, through the inlet/outlet 310 (FIG. 3) of that duct 140 and then to flow from that duct 140, as shown by arrows 405, into the region 486 of duct 175 (e.g., corresponding to the portion 480 of grain column 115) below the closed damper $\mathbf{190}_3$ through the inlet/outlet 144 of that duct 142 that opens into region 486 of duct 175 below the closed damper $\mathbf{190}_3$. The cooling air flowing in the region 486 of duct 175 may then flow from region 486, as shown by arrows 440, into the region 135 that is below blower 130 and fluidly coupled to inlet 132 of blower 130.

Grain in the grain column 115 may transfer heat to the cooling air so that the cooling air flowing in a duct 175 is heated. Note that the region 486 of duct 175 might be fluidly coupled to the inlet 132, e.g., to the suction side, of blower 130, and the region 486 of duct 175 might be at a lower pressure than air cavity 137 while blower 130 is operating. That is, blower 130 might cause the region 486 of duct 175 to be at vacuum pressure, for example.

During cooling of a zone 202 in FIG. 4, the cooling air may flow into a duct 142 from air cavity 137, as shown by an arrow 441, through the inlet/outlet 158 of that duct 142 and may then flow into grain column 115 from that duct 142, as shown by arrows 430, through the inlet/outlet 320 (FIG. 3) of that duct 142. The cooling air may then flow into a duct 140 from the respective grain column 115, as shown by arrows 425, through the inlet/outlet 310 (FIG. 3) of that duct 140 and may then flow from that duct 140 into the region 135, as shown by arrow 435, through the inlet/outlet 144 of that duct 140.

Note that the grain in the grain column 115 transfers heat to the cooling air so that the cooling air flowing into region 135 from zone 202 is heated. Also note that zone 202 might be subjected to cooling during the operation of blower 130, and thus grain dryer 100, regardless of whether any of the dampers 190 are open or closed. For example, zone 202 might receive cooling air whenever blower 130 is operating.

In FIG. 4, heating air might flow into a region 488 of duct 175, as shown by arrows 470, above closed damper $\mathbf{190}_3$, e.g., from the upper portion of duct 110 (FIG. 1). Note that region 488 of duct 175 corresponds to the portion 485 of grain column 115 above closed damper $\mathbf{190}_3$. Closed damper $\mathbf{190}_3$ might cause the heating air flowing in region 488 of duct 175 to flow into a duct 140 from region 488, as shown by arrows 450, through the inlet/outlet 144 of that duct 140 and then to flow into grain column 115 from that duct 140, as shown by arrows 455, through the inlet/outlet 310 (FIG. 3) of that duct 140. Closed damper $\mathbf{190}_3$ might then cause the heating air to flow into a duct 142 from grain column 115, as shown by arrows 460, through the inlet/outlet 320 (FIG. 3) of that duct 142 and then to flow from that duct 142 into air cavity 137, as shown by arrows 465, through the inlet/outlet 158 of that duct 142.

Note that the region 488 of duct 175 might be fluidly coupled to the outlet, e.g., to the pressure side, of blower 130, and the region 488 of duct 175 might be at a higher pressure than air cavity 137, and thus region 486 of duct 175, while blower 130 is operating.

During heating of the upper portion of a grain column 115 above duct 175, and thus above the zones 200 in FIG. 2 and above portion 485 in FIG. 4, heating air may flow into a duct 140, as shown by an arrow 471 in FIG. 4, from the upper portion of duct 110 through the inlet/outlet 144 of that duct 140 and may then flow into grain column 115 from that duct 140, as shown by arrows 472, through the inlet/outlet 310 (FIG. 3) of that duct 140. The heating air may then flow into a duct 142, as shown by arrows 473, from grain column 115 through the inlet/outlet 320 (FIG. 3) of that duct 142 and may then flow from that duct 142 into air cavity 137, as shown by arrow 474, through the inlet/outlet 158 of that duct 142.

Note that the portion of a grain column 115 above ducts 175 may be heated regardless of the configuration of dampers 190. For example, the portion of a grain column 115 above ducts 175 is heated whenever grain dryer 100 is operation (e.g., blower 130 and burner 137 are in operation), regardless of whether dampers 190 are open or closed. Also note that the heating of portion 485 above the closed damper $\mathbf{190}_3$, the cooling of portion 480 below the closed damper $\mathbf{190}_3$, the cooling of zone 202, and the heating of the portion of a grain column 115 above ducts 175 may occur concurrently while grain dryer 100 is operating.

An adjustable intake assembly 210 might be located below the lowermost ends of grain columns 115, upstream of inlet 132 of blower 130. Adjustable intake assembly 210 might be fluidly coupled to the suction side of blower 130, for example. Adjustable intake assembly 210 might be configured to adjust the amount of outside air that is drawn into grain dryer 100 from the atmosphere external to grain dryer 100. For example, adjustable intake assembly 210 might be configured to adjust the amount of outside air that enters region 135. During operation of grain dryer 100, blower 130 draws the adjusted amount of outside air into region 135.

The outside air might be cooler than the cooling air from the grain columns 115 that enters region 135 from ducts 175 and/or zone 202. The cooling air from grain columns 115 might mix with the outside air within region 135. As such, the mixed air might be warmer than the outside air. Blower 130 then causes the warmer mixed air to flow through burner 127.

The warmer mixed air acts to reduce the heating load on burner 127, thereby reducing the fuel consumption of burner 127 by about 15 to 20 percent and reducing the combined fuel and power consumption by about 30 to 40 percent, e.g., compared to pressurized cooling systems used in conventional duct-type grain dyers that do not recycle cooling air to preheat outside air before the outside air reaches the burner. The warmer mixed air is lighter (e.g., has a lower density) than the outside air. This can reduce the load on, and thus the power consumption of, blower 130, e.g., compared to pressurized cooling systems used in conventional duct-type grain dyers that do not recycle cooling air to preheat outside air before the outside air reaches the blower.

As such, adjustable intake assembly 210 might be configured to adjust the amount of outside air that is mixed with the cooling air from the grain columns 115 that is heated by the grain. For example, adjustable intake assembly 210 may be configured to adjust the amount outside air that enters region 135 through adjustable intake assembly 210 from zero percent of the cooling air that is heated by the grain, in which case adjustable intake assembly 210 does not allow any outside air to enter region 135 directly from adjustable intake assembly 210, to about 15 to 25 percent of the cooling air that is heated by the grain.

Figure 5:
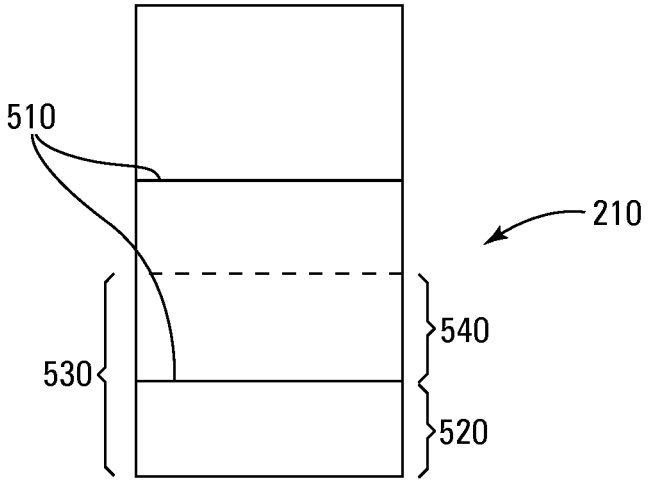
FIG. 5 is a plan view of an example of an adjustable intake assembly as viewed along line 5-5 in FIG. 2.

FIG. 5 is a plan view of an example of an adjustable intake assembly 210 as viewed along line 5-5 in FIG. 2. In the example of FIG. 5, adjustable intake assembly 210 might include a selectively adjustable door (e.g., that might be referred to as an adjustable outside-air blend door) 510 that might be configured to selectively adjust a size of an inlet 520 to the region 135 of grain dryer 100 that is under blower 130 and between grain columns 115.

For example, door 510 might be configured to selectively move (e.g., slide) over an opening 530 so as to selectively uncover a portion of opening 530 that is inlet 520 and to cover a remaining portion 540 of opening 530, as shown in FIG. 5. That is, for example, selectively sliding door 510 to different locations adjusts the size of inlet 520. For example, door 510 might be configured to selectively uncover different portions of opening 530, where the different uncovered portions of the opening 530 may respectively allow different amounts of outside air to be drawn therethrough into region 135.

When door 510 is completely closed, door 510 covers the entire opening 530, and little or no outside air is drawn directly into region 135 through adjustable intake assembly 210. Door 510 might be configured to adjust the amount of opening 530, that is inlet 520, that is uncovered by door 510 from zero percent of the size of opening 530 when door 510 covers the entire opening 530 to 100 percent of the size of opening 530 when the entire opening 530 is uncovered by door 510. When the entire opening 530 is uncovered by door 510, the amount outside air that enters region 135 through adjustable intake assembly 210 might be about 85 percent of the cooling air that gets heated by the grain.

Grain dryer 100 might include a scalper drag 198, as shown in FIG. 1. For example, scalper drag 198 might be configured to separate large foreign materials (e.g., larger than the size of the grains) from the grain before the grain enters garner bin 118 and subsequently enters grain columns 115 from garner bin 118. In one example, scalper drag 198 might include a conveyer that might drag the grain across a screen that allows the grain to pass through its mesh, but not any materials larger than the mesh, and thus the size of the grains. For example, the conveyer might include a plurality of scrapers coupled to a chain that might move in a continuous loop for moving (e.g., dragging) the scrapers over the screen. The scrapers might drag the grain and any larger materials over the screen, where the grain passes through the screen while the scrapers drag the larger materials that do not pass through the screen off the screen.

CONCLUSION

Although specific embodiments have been illustrated and described herein, it will be appreciated by those of ordinary skill in the art that any arrangement that is calculated to achieve the same purpose may be substituted for the specific embodiments shown. Many adaptations of the embodiments will be apparent to those of ordinary skill in the art. Accordingly, this application is intended to cover any adaptations or variations of the embodiments.

What is claimed is:

1. A grain dryer, comprising:

a grain column configured to receive grain to be dried; and a plurality of ducts extending from a first wall of the grain column to a second wall of the grain column in a direction that is transverse to a direction of a flow of the grain through the grain column;

wherein a first number of ducts of the plurality of ducts is selectable for handling cooling air used for cooling the grain and a second number of ducts of the plurality of ducts is selectable for handling the cooling air used for cooling the grain; and wherein the first number is different than the second number.

2. The grain dryer of claim 1, wherein the plurality of ducts comprise a plurality of first ducts closed at the first wall and having first inlet/outlets that open through the second wall into a channel between the second wall and a duct containing a burner and a plurality of second ducts closed at the second wall and having second inlet/outlets that open through the first wall into an air cavity between the first wall and a heat shield of the grain dryer.

3. The grain dryer of claim 2, wherein the first number of ducts comprises a portion of the plurality of first ducts and a portion of the plurality of second ducts, and wherein when the first number of ducts is selected for handling the cooling air, the cooling air flows from the air cavity into the portion of the plurality of second ducts through the second inlet/outlets and flows from the portion of the plurality of second ducts into the grain column and the cooling air flows from the grain column into the portion of the plurality of first ducts and from the portion of the plurality of first ducts into the channel through the first inlet/outlets.

4. A grain dryer, comprising:

a grain column configured to receive grain to be dried; and a plurality of ducts extending from a first wall of the grain column to a second wall of the grain column;

wherein the grain dryer is configured so that different numbers of the ducts of the plurality of ducts are selectable for handling cooling air used for cooling the grain;

wherein the plurality of ducts comprise a plurality of first ducts closed at the first wall and having first inlet/outlets that open through the second wall into a channel between the second wall and a duct containing a burner and a plurality of second ducts closed at the second wall and having second inlet/outlets that open through the first wall into an air cavity between the first wall and a heat shield of the grain dryer;

wherein when a number of ducts of the plurality of ducts is selected for handling the cooling air, a selected number of second ducts of the plurality of second ducts is configured so that cooling air from the air cavity flows into the selected number of second ducts through the second inlet/outlets and flows from the selected number of second ducts into the grain column and a selected number of first ducts of the plurality of first ducts is configured so that the cooling air from the grain column flows into the selected number of first ducts of the plurality of first ducts and from the selected number of first ducts into the channel through the first inlet/outlets; and further comprising an adjustable intake assembly configured to allow different amounts of outside air to be mixed with the cooling air from the channel.

5. A grain dryer, comprising:

a grain column configured to receive grain to be dried; and a plurality of ducts extending from a first wall of the grain column to a second wall of the grain column;

wherein the grain dryer is configured so that different numbers of the ducts of the plurality of ducts are selectable for handling cooling air used for cooling the grain;

wherein the plurality of ducts comprise a plurality of first ducts closed at the first wall and having first inlet/outlets that open through the second wall into a channel between the second wall and a duct containing a burner and a plurality of second ducts closed at the second wall and having second inlet/outlets that open through the first wall into an air cavity between the first wall and a heat shield of the grain dryer; and wherein the grain dryer being configured so that different numbers of the ducts of the plurality of ducts are selectable for handling the cooling air comprises the grain dryer comprising different dampers configured to be selectively closed for respectively closing off different portions of the channel respectively below different selectively closed dampers from different portions of the channel respectively above the different selectively closed dampers, wherein different numbers of the first plurality of ducts are respectively below the different selectively closed dampers and different numbers of the second plurality of ducts are respectively below the different selectively closed dampers.

6. The grain dryer of claim 1, further comprising a blower in an interior of the grain dryer so that the blower causes outside air to be drawn from an exterior of the grain dryer to the interior of the grain dryer.

7. The grain dryer of claim 1, further comprising a scalper drag configured to separate materials larger than a size of grains of the grain from the grain.

8. The grain dryer of claim 1, wherein the first number is greater than one and the second number is greater than one.

9. The grain dryer of claim 1, further comprising a plurality of dampers, wherein a damper of the plurality of dampers is configured to close a channel adjacent to the second wall at a location above the first number of ducts to select the first number of ducts.

10. The grain dryer of claim 9, further comprising a blower, wherein when the damper that is configured to close the channel adjacent to the second wall at the location above the first number of ducts closes the channel at the location above the first number of ducts, a portion of the channel below the location at which the duct is closed is below a pressure of air outside the grain dryer when the blower is operating and a portion of the channel above the location at which the duct is closed is above the pressure of the air outside the grain dryer when the blower is operating.

11. The grain dryer of claim 1, wherein the second number of ducts comprises the first number of ducts and an additional number of the plurality of ducts so that the first number of ducts and the additional number of the plurality of ducts handle the cooling air when the second number of ducts is selected for handling the cooling air.

12. The grain dryer of claim 11, wherein the additional number of the plurality of ducts handle heating air for heating the grain when the first number of ducts is selected for handling the cooling air and the second number of ducts is not selected for handling the cooling air.

13. The grain dryer of claim 12, wherein the additional number of the plurality of ducts are vertically above the first number of ducts.

14. The grain dryer of claim 12, wherein the cooling air flows from an air cavity adjacent to the first wall and into a first portion of the additional number of the plurality of ducts and from a second portion of the additional number of the plurality of ducts and into a channel adjacent to the second wall when the second number of ducts is selected for handling the cooling air, and wherein the heating air flows from the channel and into the second portion of the additional number of the plurality of ducts and from the first portion of the additional number of the plurality of ducts and into the air cavity when the first number of ducts is selected for handling the cooling air and the second number of ducts is not selected for handling the cooling air.

15. The grain dryer of claim 1, further comprising an adjustable intake assembly configured to allow different amounts of outside air to be mixed with the cooling air from a portion of the first number of ducts when the first number of ducts is selected for handling the cooling air or from a portion of the second number of ducts when the second number of ducts is selected for handling the cooling air.

16. The grain dryer of claim 1, wherein the first number of ducts and the second number of ducts both comprise ducts that are always used for handling the cooling air.

17. The grain dryer of claim 1, wherein fewer than all of the plurality of ducts are selectable for handling the cooling air so that some of the plurality of ducts are always used for handling heating air for heating the grain.

18. The grain dryer of claim 4, wherein some of the ducts of the plurality of ducts are not selectable for handling cooling air and are always used for handling heating air for heating the grain.

19. The grain dryer of claim 4, wherein some of the ducts of the plurality of ducts are always used for handling the cooling air.

20. The grain dryer of claim 5, wherein some of the ducts of the plurality of ducts are always used for handling the cooling air and some of the ducts of the plurality of ducts are always used for handling heating air for heating the grain.

* * * * *